United States Patent [19]

Durand

[11] 4,157,874

[45] Jun. 12, 1979

[54] DYE MARKING DEVICE

[75] Inventor: David Durand, Bristol, R.I.

[73] Assignee: Freeman Transfer Printing Co., East Providence, R.I.

[21] Appl. No.: 895,228

[22] Filed: Apr. 10, 1978

[51] Int. Cl.[2] ..... B43K 8/02; B43K 5/08

[52] U.S. Cl. ..... 401/4; 8/2.5 A; 101/470; 401/206

[58] Field of Search ..... 401/4, 206

[56] References Cited

U.S. PATENT DOCUMENTS

| | | | |
|---|---|---|---|
| 2,543,195 | 2/1951 | Petion | 401/206 |
| 2,783,488 | 3/1957 | Jockers | 401/206 |
| 2,964,012 | 12/1960 | Kahn et al. | 401/4 |
| 3,337,899 | 8/1967 | Rentfrow | 401/4 |
| 3,468,611 | 9/1969 | Ward | 401/206 |
| 3,551,065 | 12/1970 | DeMolin et al. | 401/206 |
| 3,640,631 | 2/1972 | Sotir | 401/206 |
| 3,653,903 | 4/1972 | Nihyakumen et al. | 96/49 |

*Primary Examiner*—Clyde I. Coughenour
*Attorney, Agent, or Firm*—Salter & Michaelson

[57] ABSTRACT

A marking device is disclosed wherein a pen-type device is utilized to store and enable markings to be produced from a dye suspended in a suspension medium such as water. The dye is of the heat sublimatible type and is finely ground and maintained in suspension by rolling action of a ball trapped within a reservoir defined by the pen body. A primary chamber is positioned adjacent the reservoir and a porous marking element is in turn frictionally and slidably positioned in the primary chamber. Valve means normally urged to a closed position enables ink to move from the reservoir into the primary chamber when the valve is caused to open, as by pressure against the marking element.

2 Claims, 6 Drawing Figures

DYE MARKING DEVICE

BACKGROUND AND SUMMARY OF THE INVENTION

This invention relates to a marking system and particularly a marking device which can be used to transfer heat sublimatible dyes from a transfer sheet to a substrate in an accurate and easily controlled pattern such that images and designs may be imprinted thereon, as by free hand drawing. Such sublimatible dyes are known and are rapidly supplanting the use of conventional printing processes wherein the substrate material to be imprinted presents difficulty in accepting an image or design formed by conventional processes, i.e. off-set, rotogravure, and the like. Such substrates include fabric materials which are difficult to print by such conventional printing processes. The above described heat transfer printing method additionally enables the transfer of designs to substrates while utilizing a relatively low technology and inexpensive heat transfer equipment. Such is accomplished by the use of a transfer sheet imprinted with inks containing sublimatible dyes by using conventional printing techniques at a central location. The thus formed transfer sheets are then shipped to secondary locations wherein the design thus imprinted on the transfer sheet is heat transferred to the final substrate, that is, the fabric or other material in which the design is to be ultimately incorporated. In the use of such heat sublimatible inks, it would be desirable to be able to informally produce one or a limited number of transfer sheets in an informal manner, as by free hand drawing, so as to experiment in the creation of new fabric designs or to enable the formation of one-of-a-kind artistic representations through such heat transfer processes.

It is accordingly a primary object of the present invention to provide a marking device which enables the storage of such above-indicated sublimatible dyes in such a manner that the dye may be easily conveyed to a transfer sheet, as by free hand drawing.

These and other objects of the invention are accomplished by the use of a marking device having an elongated closed body having primary and secondary chambers. The primary chamber is adapted to hold an elongated porous marking element which is utilized to absorb and lay down a film of ink upon the transfer sheet. The body of the marking device further includes a secondary chamber which acts as an ink reservoir. Longitudinal movement of the marking element relative to the body enables a normally closed valve positioned between the primary and secondary chambers to be opened to admit ink from the reservoir to the primary chamber. A ball positioned within the secondary chamber serves to maintain the sublimatible dye in suspension in the ink by rolling back and forth within the reservoir when the device is shaken or normally moved, as during drawing.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
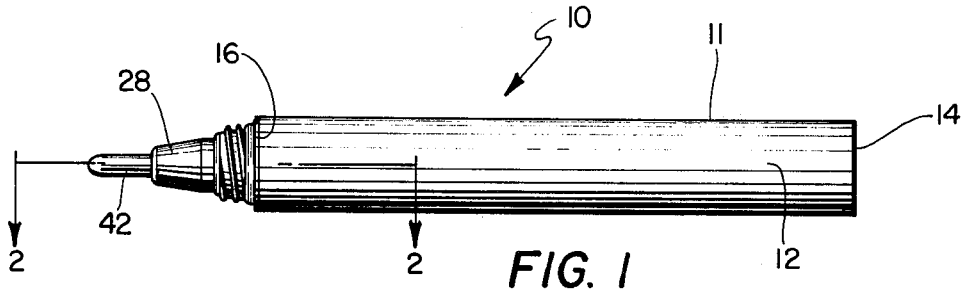
FIG. 1 is a perspective view of the marking device of the present invention.

Turning now to the drawing, the marking device 10 of the present invention is shown as including an elongated body 11 comprising a tube 12, conventionally formed of metal or similar generally rigid material, and having a closed end 14 and an open end 16. A separable forward member 18 having a rearwardly extending cylindrical portion 20 is adapted to interfit with the open end 16 of the tube 12 in liquid-tight relationship such that ink 22 received within the tube will not leak from such connection, that is, the radial dimension of the portion 20 is such that it forms a tight fit with the open tube end 16. In that regard, the peripheral edge 24 of the open tube end 16 is adapted to abut against an outwardly extending shoulder 26 formed on the member 18.

The forward portion of the member 18 is provided with an extension 28 having a longitudinally extending bore 30 provided therein. The bore 30 terminates at its forward end in a circular opening 32 and communicates with a recess 34, which includes valve opening 36 surrounded by peripheral wall or shoulder 38, against which a valve closure member 40 is adapted to fit in sealing relationship. A porous marking element 42 extends through the bore 30 and is positioned so as to project outwardly of the opening 32 at the forward end thereof and abut in contact with the valve member 40 at the rear end thereof. Such porous marking element may be formed from comrpessed polyester-2 material, as is known in the art, its essential features being that it is capable of transmitting ink from the recess 34 to the marking tip portion 46 thereof. The ink may be transmitted from tip 46 to the transfer sheet (not shown) in the desired design, as by free hand or by any suitable mechanical device.

The ink includes fine particle size heat sublimatible dyes, i.e. preferably particle sizes of about one-half micron. The dye may be ground into crystalline form by any suitable micropulverizing equipment. The dye particles are then mixed with a suspension medium, such as water, and an emulsion binder so as to form an ink emulsion having enough dye dispersed therein so that sufficient dye will be transferred to the heat transfer sheet by the marking element 42 to be subsequently sublimated to the substrate, as contemplated in the heat transfer printing process previously referred to.

Figure 2:
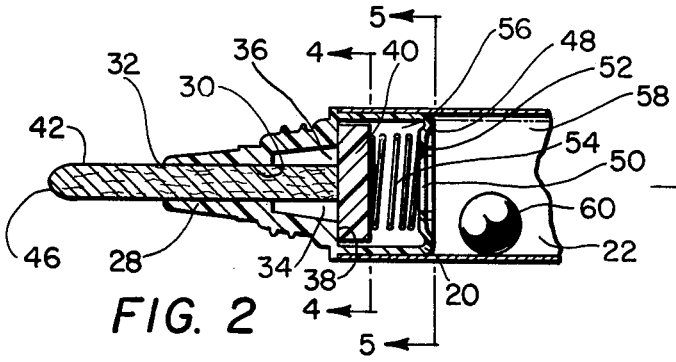
FIG. 2 is a side sectional view taken along the line 2—2 thereof showing the valve in the normally closed position.
Figure 3:
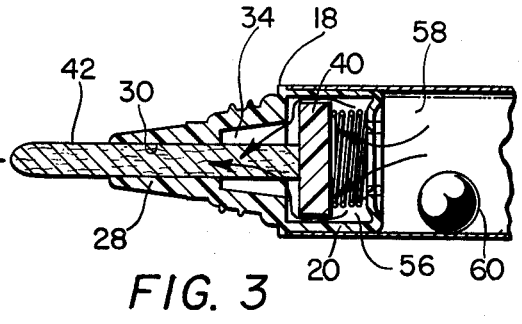
FIG. 3 is a partial side sectional view similar to FIG. 2 but showing the valve in its open position.
Figure 4:
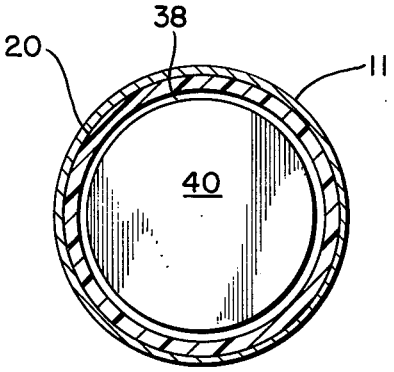
FIG. 4 is a sectional view taken along the line 4—4 of FIG. 2.
Figure 5:
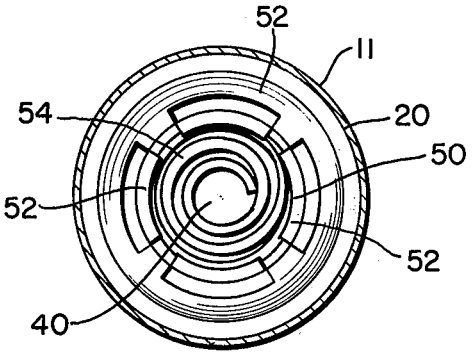
FIG. 5 is a sectional view taken along line 5—5 of FIG. 2.
Figure 6:
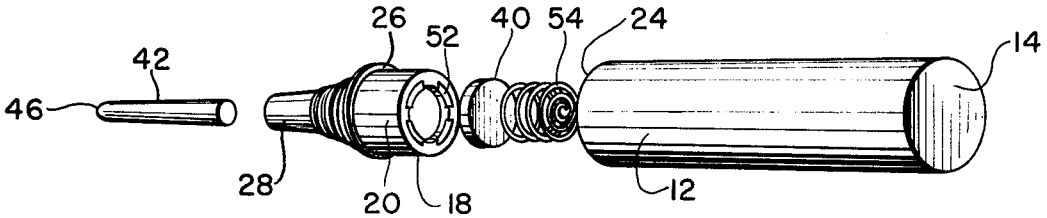
FIG. 6 is an elevational view of the various components of the marking device shown in expanded or exploded position relative to each other.

The rear portion 20 of the member 18 terminates in a second wall 48 radially inwardly extending from the periphery thereof and defining an opening 50. A plurality of inwardly extending tabs 52 serve to entrap a coil spring 54 disposed within a secondary chamber 56. The forward end of the spring contacts the valve member 40 while the rear end thereof contacts the tabs 52. The spring 54 is normally somewhat compressed to spring urge the valve 40 to the closed position shown in FIG. 2 of the drawing. Upon further spring compression as by relative rearward motion of the porous element 42, the valve member 40 is forced away from its seat 38 so as to permit access to the recess 34. In this manner then, the recess or primary chamber 34 may be placed in direct communication with a secondary chamber 56 and a secondary reservoir or chamber 58. The reservoir 58 is formed by the interior portions of the tube 12 disposed to the rear of the secondary wall 48 and secondary chamber 56. The reservoir 58 and secondary chamber 56 at all times maintain a supply of ink 22. In order to keep the dye component of the ink in suspension so as to insure that the desired dye concentration is maintained throughout the ink 22, a ball 60 is entrapped within reservoir 58 of the tube 12 and is freely rotatable or movable back-and-forth therein. The ball is formed from a heavy corrosion resistant material such as stainless steel and thus can easily move by gravity back and forth or be vigorously shaken prior to the use of the marking device 10 in order that the ink 22 will be properly mixed therein. The spring 54 may also be formed of stainless steel while the valve 40 and member 18 are generally formed from molded plastic, such as polyethylene or polypropylene. It will thus be seen that a small portion of the ink may be admitted to the primary chamber or recess 34 so as to be in communication with the marking element 42 by the elevation of the marking device 10 and by exerting slight downward compression on the tip 46 to the extent necessary to unseat the valve member 40 and place the two chambers in communication with each other. Ink 22 maintained in the secondary chamber 56 and reservoir 58 can then pass into the primary chamber 34, thus assuring that ink of the correct dye concentration is introduced to the marking element 42 when it is desired to utilize same. In conventional marking devices of this type, the writing element, which may be a polyester wadding, is always in contact with the ink reservoir. However, with sublimatible inks of the type used herein, there would be a tendancy for the water in the ink solution to evaporate or become absorbed by the writing element leaving the crystal or powder colorant behind, whereby the writing tip would not contain the proper dye concentration. Obviously this would be highly disadvantageous and is avoided by the present unique construction incorporating two distinct chambers, and the means, such as the movable ball 60, for assuring that the ink 22 is maintained in the desired concentration prior to being admitted to the primary chamber 34 where it contacts the marking element 42 just prior to the time the device 10 is used. It will be understood that although the marking element 42 is flexible in nature, it has sufficient body so that when pressure is exerted against the tip 46, the valve 40 will be forced to open position, as aforedescribed.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A marking device comprising an elongated closed body capable of manipulation by the human hand, said body comprising first, second and third chambers serially disposed with respect to each other along the length of said body, said first chamber disposed at the forward end of said body and terminating at its forward end in an open ended bore having an elongated porous marking element frictionally and slidably extending therethrough in communication with said first chamber at one end thereof and projecting outwardly from the open end of said bore and the other end thereof, said second chamber adjacent said first chamber and disposed to the rear thereof, a shoulder inwardly projecting from said body and disposed between said first and second chambers, said shoulder defining a centrally disposed opening communicating between said first and second chambers and a valve seat, a valve and a valve spring disposed in said second chamber, said valve normally urged by said spring against said shoulder so as to normally separate said first and second chambers from each other, said body including a separable forward member, said member defining said first chamber, said open bore, and said valve seat, said separable member having a portion rearwardly extending from said valve seat and defining a housing for said spring, said housing having inwardly extending means for restraining and maintaining said spring in contact with the side of said valve opposite to that which said element is adapted to contact, said third chamber adjacent said second chamber with said housing inwardly extending means defining the adjacent boundries thereof while permitting free liquid access between said first and second chambers, said second and third chambers having ink in the form of a finely divided heat sublimatible dye suspended in a lquid medium disposed therein and thus forming a reservoir for said element, means in said third chamber for keeping said dye in suspension, including a freely rollable ball disposed therein so as to agitate the dye suspension and keep it properly mixed, said housing and the inwardly extending means thereof preventing said ball from entering said second chamber and contact with said spring and said valve member so as to prevent damage thereto, the rear end of said element being adapted to contact the forward side of said valve, whereby pressure against the tip of said element, as by pressing the tip against a surface with the pen body at least partially elevated causes said valve to open and ink to flow by gravity into said first chamber into contact with said element.

2. The marking device of claim 1, wherein said suspension medium is water.

* * * * *